US006091390A

United States Patent [19]

Sim

[11] Patent Number: 6,091,390

[45] Date of Patent: Jul. 18, 2000

[54] DRIVER OF LIQUID CRYSTAL DISPLAY

[75] Inventor: Soo Seok Sim, Kyungsangbuk-do, Rep. of Korea

[73] Assignee: LG Semicon Co., Ltd., Chungcheongbuk-do, Rep. of Korea

[21] Appl. No.: 08/890,566

[22] Filed: Jul. 9, 1997

[30] Foreign Application Priority Data

Oct. 24, 1996 [KR] Rep. of Korea ..... 96-48005

[51] Int. Cl.[7] ..... G09G 3/36

[52] U.S. Cl. ..... 345/98; 345/100

[58] Field of Search ..... 345/204, 92, 98, 345/100, 87; 327/530

[56] References Cited

U.S. PATENT DOCUMENTS 5,196,738 3/1993 Takahara et al. ..... 307/296.1
5,252,956 10/1993 Senn et al. ..... 345/100
5,510,748 4/1996 Erhart et al. ..... 327/530
5,708,453 1/1998 Tsuchida et al. ..... 345/87
5,726,676 3/1998 Callahan, Jr. et al. ..... 345/204

*Primary Examiner*—Steven J. Saras
*Assistant Examiner*—Alecia D. Nelson
*Attorney, Agent, or Firm*—Morgan, Lewis & Bockius LLP

[57] ABSTRACT

A driver of an LCD having a plurality of channels includes a counter for counting a signal having a predetermined level; a DAC for sequentially increasing or decreasing one level of a plurality of input voltage levels when the counter counts; a plurality of comparators for comparing its input data with the output of the counter, a comparator being formed for each channel; a plurality of level shifters for compensating for the level difference between the DAC and relevant comparator; and a plurality of sample/hold portions for sampling a current output from the DAC according to the output signal of the level shifter, and for holding the sampled value when the counter counts.

13 Claims, 5 Drawing Sheets

DRIVER OF LIQUID CRYSTAL DISPLAY

This application claims the benefit of Korean Application No. 48005/1996, filed in Korea on Oct. 24, 1996, which is hereby incorporated by reference.

BACKGROUND OF THE INVENTION

1. Field of the Invention

The present invention relates to a liquid crystal display (LCD) and, more particularly, to a column driver of an LCD.

2. Discussion of the Related Art

One of the most important portions of a thin film transistor-liquid crystal display (TFT-LCD) is a digital-to-analog converter (DAC) which generates an output voltage corresponding to digital input data. The DAC includes a decoder switch that selectively outputs a voltage corresponding to one of a plurality of input voltages. The DAC applies sixty-four input voltages in order to display sixty four gray levels, and has sixty-four analog switches and decoders for the purpose of selecting one voltage corresponding to one of sixty four input data. Accordingly, if there are 240 output channels, then 64×240 analog switches are required, and an interconnection connecting sixty four input voltages to each analog switch becomes complicated.

FIG. 1 is a block diagram of a column driver of a conventional TFT-LCD. Referring to FIG. 1, the conventional column driver includes a control logic 11 having an address shift register, and a resistor string 12 for converting input voltage levels V0 to V8 into voltage levels V0 to V63. An input register 13 sequentially stores R, G, B data which are applied thereto when the shift register is shifted, and a storage register 14 stores the R, G, B data sequentially stored in input register 13 such that each of R, G, B data is stored at the same time. A DAC 15 compares sixty four voltages output from resistor string 12 according to the data output from storage register 14, and generates a voltage corresponding to the input data.

FIG. 2 is a block diagram of a conventional DAC corresponding to one channel. Referring to FIG. 2, the conventional DAC includes a level shifter 21 and a plurality of multiplexers 22. Level shifter 21 makes the level of data output from storage register 14 coincide with sixty four voltage levels V0 to V63 output from resistor string 12 of FIG. 1. A multiplexer 22 compares sixty four input voltages, and outputs a voltage corresponding to the input data. Multiplexer 22 uses a data signal output from level shifter 21 and data inverted from the data signal output of level shifter 21 as selection signals S0, S1, S2, S3, S4, S5, and $\overline{S0}$, $\overline{S1}$, $\overline{S2}$, $\overline{S3}$, $\overline{S4}$, $\overline{S5}$.

Now, the operation of the conventional LCD driver will be explained below. As shown in FIG. 2, multiplexer 22 sequentially compares two voltages from the sixty four input voltages with each other, and selectively outputs one voltage level corresponding to input data. Here, for the selection signals of multiplexer 22, the data signal and the inverted data signal that pass through the level shifter 21 are used. FIG. 3 is a block diagram of a conventional voltage interconnection. The voltage interconnection includes as many DACs as there are channels.

However, the conventional LCD driver has the following problems. When a plurality of channels are required, a plurality of DACs, each of which has a plurality of multiplexers, are also needed. Accordingly, the area occupied by the DACs becomes large, and thus the driver area also becomes large. Furthermore, the interconnection for connecting sixty four voltage levels to each DAC becomes complicated.

SUMMARY OF THE INVENTION

Accordingly, the present invention is directed to an LCD driver that substantially obviates one or more of the problems due to limitations and disadvantages of the related art.

An object of the present invention is to provide an LCD driver where a minimal number of DACs are used for a plurality of channels in order to simplify its configuration and minimize the driver size.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an LCD driver having a plurality of channels includes a counter for counting a signal having a predetermined level; a DAC for sequentially increasing or decreasing one level of a plurality of input voltage levels when the counter counts; a plurality of comparators for comparing its input data with the output of the counter, the comparators being formed on each channel; a plurality of level shifters for compensating for the level difference of the DAC and relevant comparator; and a plurality of sample/hold portions for sampling the output currently output form the DAC portion according to the output signal of the level shifter, and for holding the sampled value when the counter counts.

In another aspect of the present invention, a driver of liquid crystal display having a plurality of channels includes a counter counting a signal having a predetermined level; digital-to-analog converter (DAC) coupled to the counter and sequentially changing one level of a plurality of input voltage levels according to the counter; a plurality of comparators coupled to the counter and corresponding input data and comparing the corresponding input data to an output of the counter, the plurality of comparators corresponding to the plurality of channels; a plurality of level shifters coupled to the comparator and compensating for a level difference between the DAC and relevant ones of the comparators; and a plurality of sample and hold units coupled to the DAC and the level shifters, the sample and hold units sampling a current output from the DAC according to an output signal of the level shifter, and holding the sampled value when the counter counts.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF PREFERRED EMBODIMENTS

Reference will now be made in detail to the preferred embodiments of the present invention, examples of which are illustrated in the accompanying drawings.

Figure 1:
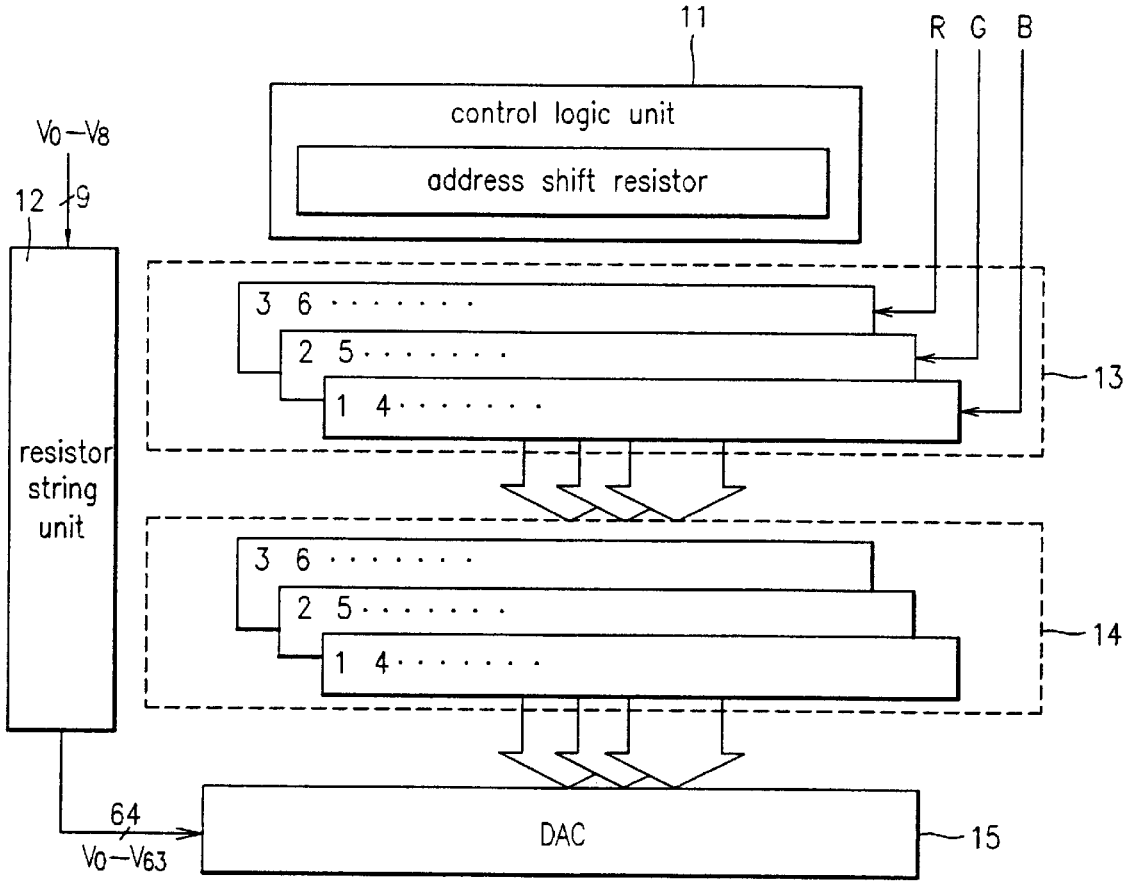
F I G.1 prior art
FIG. 1 is a block diagram of a column driver of a conventional TFT-LCD.
Figure 2:
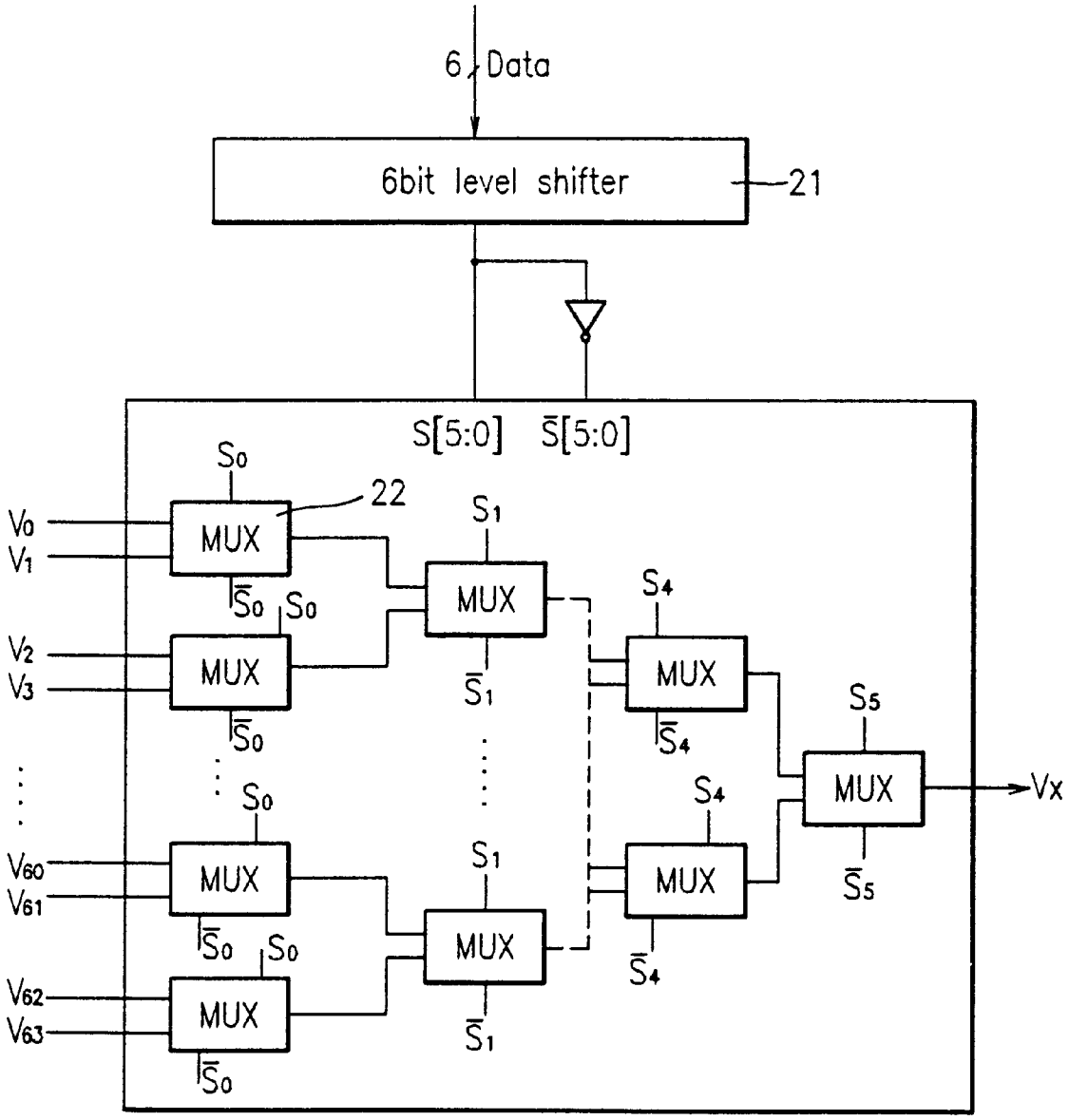
F I G.2 prior art
FIG. 2 is a block diagram of a conventional DAC.
Figure 3:
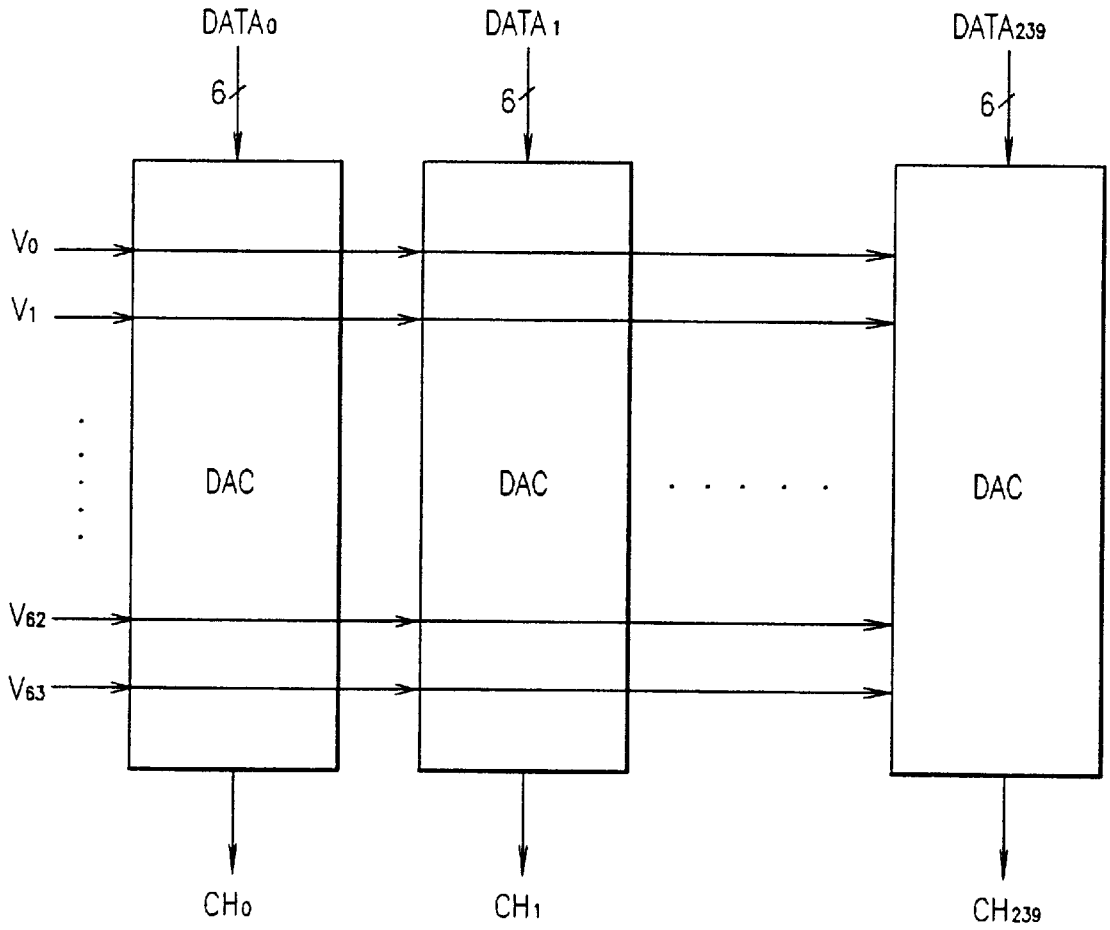
F I G.3 prior art
FIG. 3 is a block diagram of a conventional voltage interconnection.
Figure 4:
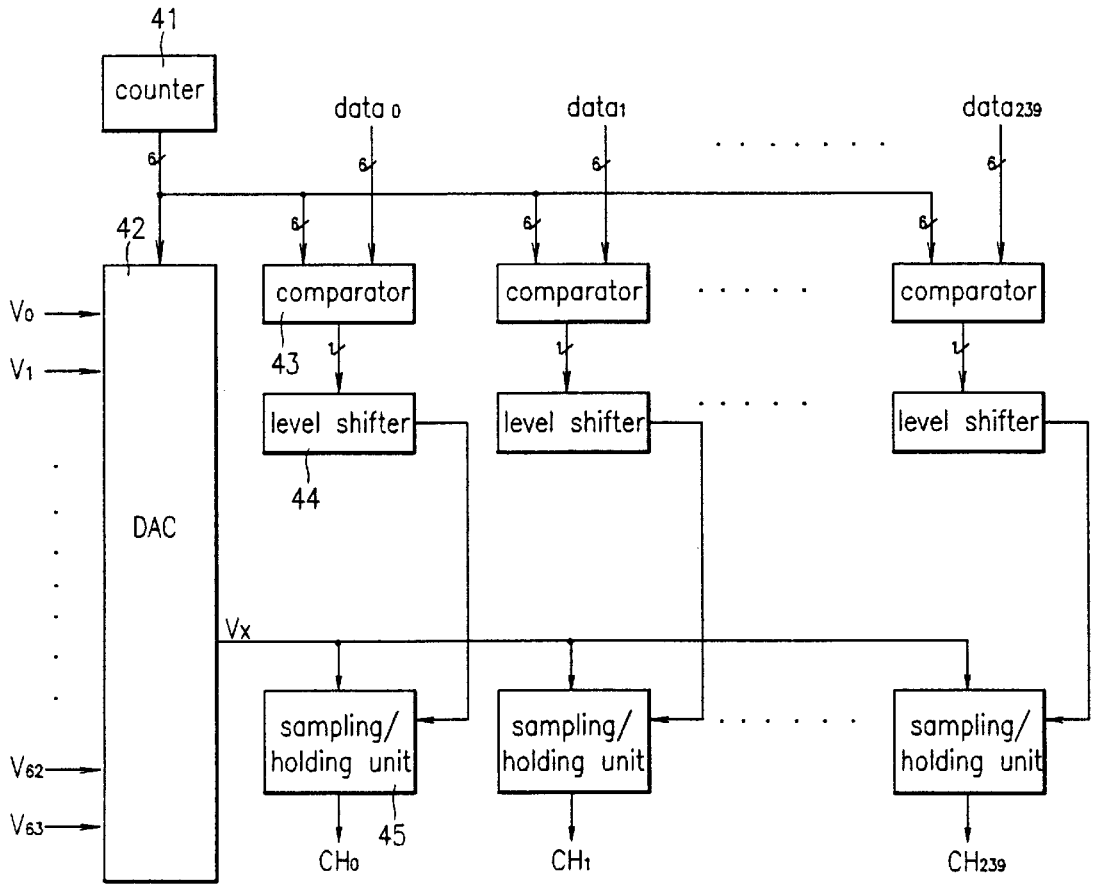
FIG. 4 is a block diagram of an LCD driver according to the present invention.

FIG. 4 is a block diagram of an LCD driver according to the present invention. Referring to FIG. 4, the driver includes a counter 41, a DAC 42 for increasing or decreasing one level of an input voltage according to the counter 41, a digital comparator 43 for comparing the output of counter 41 with input data, a level shifter 44 compensating for the level difference between digital comparator 43 and DAC 42, and a sample/hold unit 45 for sampling and holding the voltage currently output from DAC 42 when the output of counter 41 and input data are identical. Here, an up-counter or a down-counter can be used as counter 41. The sample/hold unit 45, digital comparator 43, and level shifter 44 are provided as many as the number of channels.

The operation of the LCD driver of the present invention will be explained below. As shown in FIG. 4, when counter 41 up-counts or down-counts, one level of the output voltage of DAC 42, which receive sixty four voltage levels as its input, is sequentially increased or decreased. Here, the output of counter 41 is connected to a plurality of digital comparators each of which corresponds to each channel, and applied to digital comparator 43. The input data is applied to one terminal of digital comparator 43 from the least significant bit. Accordingly, digital comparator 43 compares the output of counter 41 with the input data, and outputs a digital signal of "0" or "1".

The output signal of digital comparator 43 is a digital signal having a level of approximately 0 to 5V. However, the level of the output signal of DAC 42 is approximately 0 to 10V. Thus, the output signal levels of digital comparator 43 and DAC 42 are different from each other. In order to solve this problem, one bit level shifter 44 is provided to the output terminal of digital comparator 43.

Accordingly, if the output of the counter and input data are identical, sample/hold unit 45 of the corresponding channel samples the voltage currently output from DAC 42. When counter 41 up-counts or down-counts, the input data and the output of counter 41 are different from each other. Thus, sample/hold unit 45 holds the sampled voltage. The aforementioned process is applied to each channel. By doing so, from sixty four voltage levels, the voltage corresponding to the input data is output from the relevant channel.

Figure 5A:
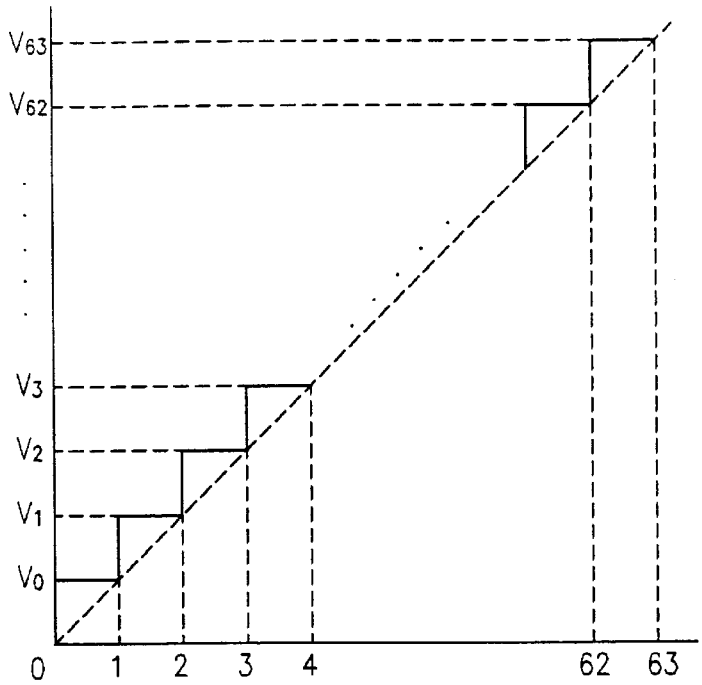
FIGS. 5A and 5B show variations of the output voltages of the LCD driver according to the present invention.
Figure 5B:
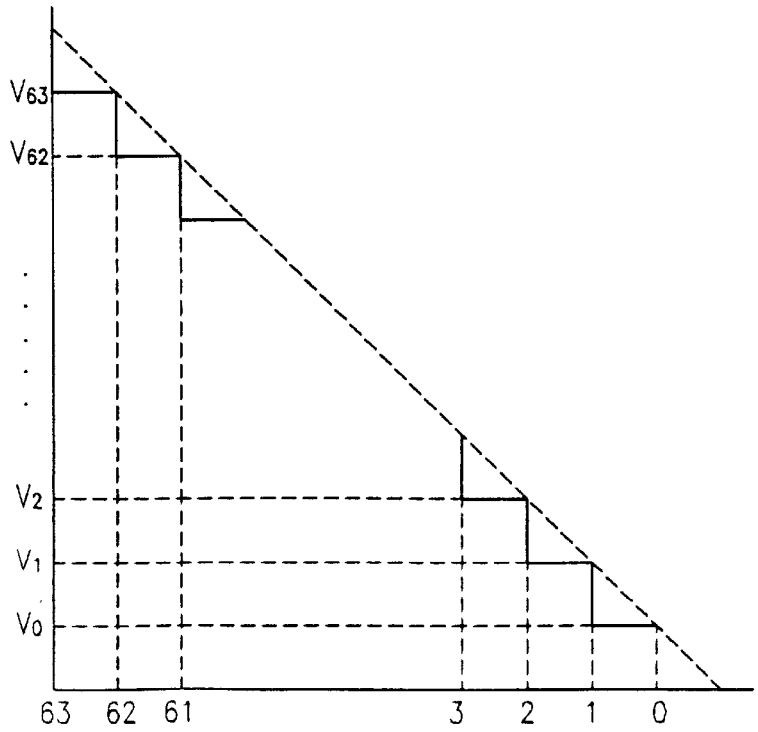

FIGS. 5A and 5B show the output of counter 41 of the present invention. FIG. 5A shows the output voltage variation in case that an up-counter is used as the counter, and FIG. 5B shows output voltage variation in case of a down-counter.

As described above, the present invention uses only one DAC. Accordingly, the area occupied by the DAC is reduced, thereby maximizing the driver size.

It will be apparent to those skilled in the art that various modifications and variations can be made in the liquid crystal display driver of the present invention without departing from the spirit or scope of the invention. Thus, it is intended that the present invention cover the modifications and variations of this invention provided they come within the scope of the appended claims and their equivalents.

What is claimed is:

1. A driver of liquid crystal display having a plurality of channels, the driver comprising:

a counter counting a signal having a predetermined level;

only a single digital-to-analog converter (DAC) coupled to the counter and sequentially increasing one level of a plurality of input voltage levels according to the counter;

a plurality of comparators coupled to the counter and corresponding input data and comparing the corresponding input data to an output of the counter, and outputting a high or low signal, the plurality of comparators corresponding to the plurality of channels;

a plurality of level shifters coupled to the comparator and compensating for a level difference between the DAC and relevant ones of the comparators; and a plurality of sample and hold units coupled to the DAC and the level shifters, the sample and hold units sampling a current output from the DAC according to an output signal of the level shifter, and holding the sampled value when the counter counts.

2. The driver according to claim 1, wherein the counter includes an up-counter.

3. The driver according to claim 1, wherein the level shifter includes one-bit level shifter.

4. The driver according to claim 1, wherein the comparator includes a digital comparator.

5. A driver of liquid crystal display having a plurality of channels, the driver comprising:

a counter counting a signal having a predetermined level;

only a single digital-to-analog converter (DAC) coupled to the counter and sequentially increasing one level of a plurality of input voltage levels according to the counter, a plurality of comparators coupled to the counter and corresponding input data and comparing the corresponding input data to an output of the counter, and outputting a high or low signal, the plurality of comparators corresponding to the plurality of channels;

a plurality of level shifters coupled to the comparator and compensating for a level difference between the DAC and relevant ones of the comparators; and a plurality of sample and hold units coupled to the DAC and the level shifters, the sample and hold units sampling a current output from the DAC according to an output signal of the level shifter, and holding the sampled value when the counter counts.

6. The driver according to claim 5, wherein the counter includes a down-counter.

7. The driver according to claim 5, wherein the level shifter includes one-bit level shifter.

8. The driver according to claim 5, wherein the comparator includes a digital comparator.

9. A driver of liquid crystal display having a plurality of channels, the driver comprising:

a counter counting a signal having a predetermined level;

only a single digital-to-analog converter (DAC) coupled to the counter and sequentially changing one level of a plurality of input voltage levels according to the counter;

a plurality of comparators coupled to the counter and corresponding input data and comparing the corresponding input data to an output of the counter, and outputting a high or low signal, the plurality of comparators corresponding to the plurality of channels;

a plurality of level shifters coupled to the comparator and compensating for a level difference between the DAC and relevant ones of the comparators; and a plurality of sample and hold units coupled to the DAC and the level shifters, the sample and hold units sampling a current output from the DAC according to an output signal of the level shifter, and holding the sampled value when the counter counts.

10. The driver according to claim 9, wherein the counter includes an up-counter.

11. The driver according to claim 9, wherein the counter includes a down-counter.

12. The driver according to claim 9, wherein the level shifter includes one-bit level shifter.

13. The driver according to claim 9, wherein the comparator includes a digital comparator.

* * * * *